US005486092A

United States Patent [19]

Borg et al.

[11] Patent Number: 5,486,092

[45] Date of Patent: Jan. 23, 1996

[54] HOUSING FOR A VORTEX-FLOW TYPE PUMP

[75] Inventors: Torolf Borg, Hasselby; Per E. Strinning, Spanga, both of Sweden

[73] Assignee: ITT Flygt Ab, Solna, Sweden

[21] Appl. No.: 317,079

[22] Filed: Oct. 3, 1994

[51] Int. Cl.[6] ..... F04D 17/00

[52] U.S. Cl. ..... 415/225; 415/182.1

[58] Field of Search ..... 415/182.1, 206, 415/225

[56] References Cited

U.S. PATENT DOCUMENTS

| | | | |
|---|---|---|---|
| 3,759,628 | 9/1973 | Kempf | 415/225 |
| 3,918,829 | 11/1975 | Korzec | 415/225 |
| 4,076,179 | 2/1978 | Tsukube | 415/225 |
| 4,475,868 | 10/1984 | Renger | 415/225 |
| 4,592,700 | 6/1986 | Toguchi et al. | 415/225 |
| 4,676,718 | 6/1987 | Sarvanne | 415/225 |
| 5,181,841 | 1/1993 | Kirkland | 415/225 |

*Primary Examiner*—John T. Kwon
*Attorney, Agent, or Firm*—Menotti J. Lombardi

[57] ABSTRACT

Upper and lower housing portions combine to define a fluid-working area within the housing, and the portions are dissimilar. The lower housing portion is substantially circular, having a constant radius, whereas the upper housing portion is volute-shaped, having an increasingly extending radius and a continuously growing depth, in the direction of the outlet. Correspondingly, the lower housing portion has a continuously diminishing depth, in the direction of the outlet.

10 Claims, 2 Drawing Sheets

HOUSING FOR A VORTEX-FLOW TYPE PUMP

BACKGROUND OF THE INVENTION

This invention pertains to pumps which are able to operate totally or partly submersed in the pumped medium, such as vortex-flow type pumps, and in particular to a novel housing for such vortex-flow type pumps.

Commonly, the pumped medium, to which the pumps are applied, contains some considerable amount of solid bodies. Waste water, and water found on construction sites, are typical of the pumped media which have solid bodies therein, and for such applications, the so-called vortex-flow type pump provides certain advantages over the conventional centrifugal pump, especially with respect to small dimensions thereof.

A vortex-flow type pump is characterized by the fact that the impeller is axially displaced in the pump housing as compared with a conventional centrifugal pump. This means that a wide, free throughlet is obtained, and thus the risk for clogging is often diminished. Consequently, it is then often possible to use smaller pumps for pumping heavily polluted liquids, and thus the costs can be reduced. Too, the fact that a vortex impeller is simpler to manufacture than a centrifugal impeller further decreases the costs.

The vortex-flow type pump, however, has certain disadvantages. Its efficiency is often lower as compared with a conventional centrifugal pump. The head often becomes lower even at small volume flows and, in addition, the power demand thereof rises rapidly at increasing volume flow.

In the conventional vortex-flow type pump, liquid is sucked in axially, through an inlet and is thrown towards the circumference of the housing by the impeller vanes, and is finally pushed out through the outlet. The housing area between the bottom of the housing and the impeller vanes has a prescribed minimum dimension, which is dictated By cognizant authorities, when waste water is pumped. This is to insure that solid bodies, up to a certain dimension, shall be able to pass through the pump without being blocked. The disadvantage caused by the vanes-to-housing bottom area is that eddies occur which bring back a part of the of the liquid to the center, and in addition check the rotation of the impeller and increase the risks for cavitation and vibration. The Swedish Patent No. 462 869 shows a pump in which such problems are alleged to be solved by providing the impeller vanes with deflection means toward preventing the liquid from flowing back to the center. A problem with this approach, however, is that the risks for clogging increase.

As noted, a disadvantage of the vortex-flow type pump is the strong increase of power demand at increasing volume flow. A prior art device which addressed this problem is shown in the Swedish Patent No. 374 415 in which the pump housing is provided with elastic parts which choke the throughlet at certain pressure conditions.

The purpose of this invention is to disclose a housing for a vortex-flow type pump having an increased efficiency and an increase in the possible head thereof, especially at small volume flows.

SUMMARY OF THE INVENTION

It is an object of this invention to set forth an improved pump housing of the so-called vortex-flow type, having an impeller with vanes, an axial inlet, a tangential-to-radial outlet, and upper and lower housing portions, wherein the improvement comprises said lower housing portion is essentially of circular design; and said upper housing portion has a volute conformation, with a continuously increasing radius in the direction of said outlet.

It is also an object of this invention to disclose a housing for a vortex-flow type pump, comprising an upper housing portion; and a lower housing portion; wherein said upper housing portion comprises means for rotatably receiving an impeller therewithin; said lower housing portion has a circular configuration; and said upper housing portion has a volute conformation.

Further objects of this invention, as well as the novel features thereof, will become apparent by reference to the following description, taken in conjunction with the accompanying figures.

DETAILED DESCRIPTION OF THE PREFERRED EMBODIMENT

Figure 1:
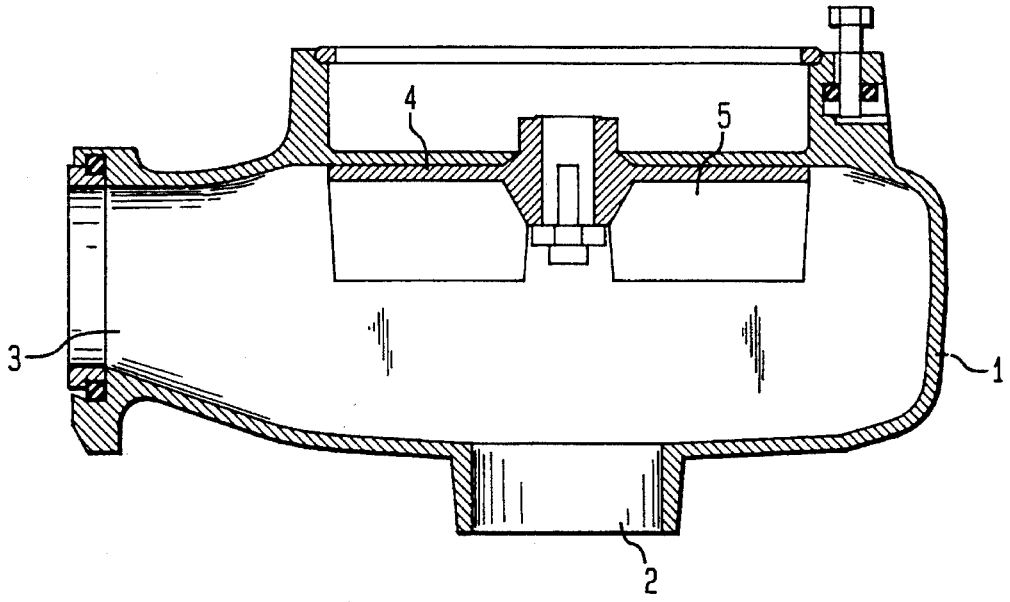
FIG. 1 (PRIOR ART)
FIG. 1 is a cross-sectional view, taken through a known, prior art, vortex-flow type pump, the same disclosing the configuration of the housing thereof.

As shown in FIG. 1, the conventional, vortex-flow type pump has a somewhat symmetrical housing 1 with an axial inlet 2, and a radial outlet 3. An upper portion of the housing 1 rotatably receives an impeller 4 which has a plurality of vanes 5. It is in the lower half of the housing 1, i.e., in the area of the housing 1 which obtains between the bottom thereof and the vanes 5, in which the aforesaid eddies occur and return some of the pumped liquid back to the center of the housing.

Figure 2:
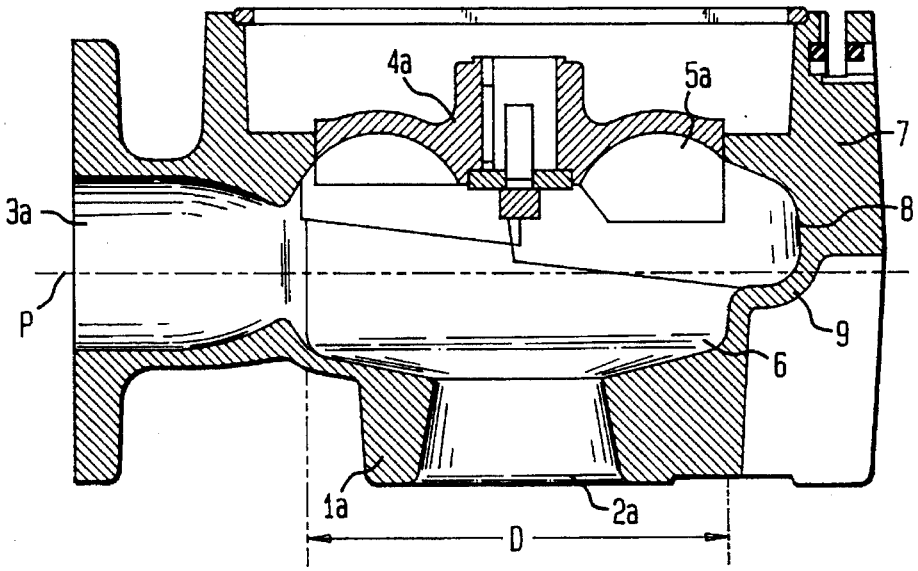
FIG. 2 is a cross-sectional view, like that of FIG. 1, albeit of a vortex-flow type pump having the novel housing therefor, according to an embodiment of the invention.

The improved vortex-flow type pump housing 1*a* is shown in FIG. 2. It has an axial inlet 2*a* and a radial outlet 3*a*. The housing 1*a* receives an impeller 4*a* which has a plurality of vanes 5*a*. In this embodiment however, the housing 1*a* is not symmetrical. It has a lower housing portion 6 which is essentially of circular design, and an upper housing portion 7 which has a volute conformation. The volute conformation of the upper housing portion 7 comprises an outer, circumferential wall 8 and a bottom wall 9. The lower housing portion 6 has a constant diameter "D". The housing 1*a* has a horizontal plane "P" which bisects the outlet 3*a*. With reference to the plane "P", the upper housing portion 7 has a continuously increasing axial extension, and the lower housing portion 6, correspondingly, has a continuously decreasing axial extension.

Figure 3:
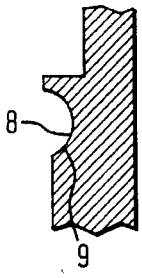
FIGS. 3, 4 and 5 show successive, cross-sectional cuts through the novel housing of FIG. 2, circumferentially thereof and through the upper housing portion thereof, in the direction of the pump outlet.
Figure 4:
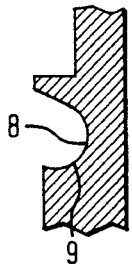
Figure 5:
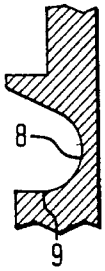
Figure 6:
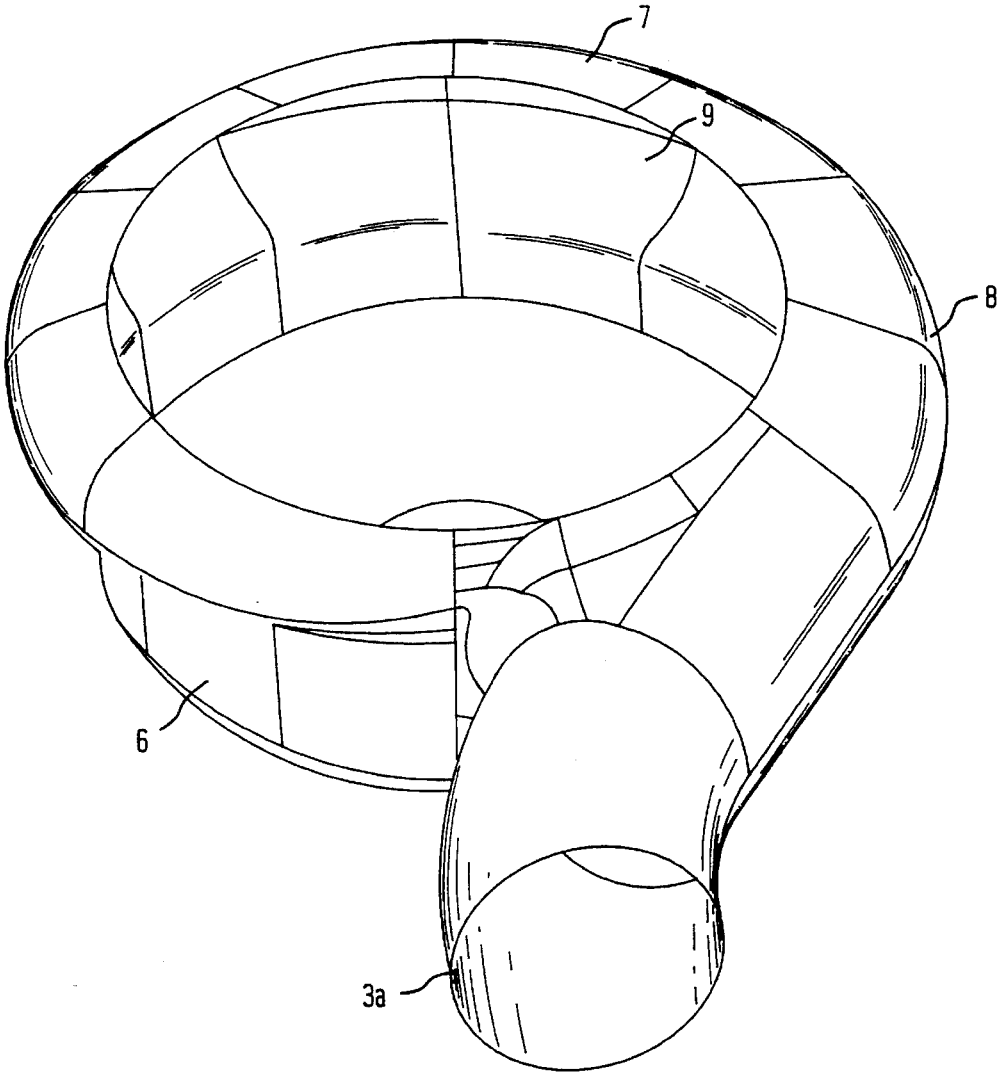
FIG. 6, is a three dimensional drawing of the housing.

For having a volute conformation, of course, the upper housing portion 7 has a continuously increasing radius, as can be appreciated by reference to FIGS. 3 through 5. The outer, circumferential wall 8 extends, further and further, beyond the limits of the diameter "D" of lower housing portion 6. In addition, and also as evidenced in FIGS. 3 through 5, the upper housing portion 7 has a continuously increasing axial extension. The expanse of the wall 8 grows steadily greater and, correspondingly, the bottom wall 9 is progressively lowered. The complement of this, of course, is that the lower housing portion 6 has an increasingly diminishing axial extension.

The unexpected benefit arising from forming the housing 1*a* with a substantially circular lower housing portion 6 and a volute-shaped, upper housing portion 7, is that the volute conformation prevents a return of the pumped liquid to the center of the pump. Instead, it forces a greater amount of the liquid to remain in the upper housing portion 7 and get pushed towards the outlet 3*a*. This decreases the losses to a great extent. An additional advantage which proceeds from the use of a volute conformation in the upper housing portion 7 is that a considerable pressure increase, at small volume flows, can be obtained through the flow concentration which the volute provides. In a Corresponding way, the volute conformation insures that the power demand, at increasing volume flow, can be limited, as compared with the conventional vortex-flow type pumps with totally, cylindrically-formed housings.

While I have described my invention in connection with a specific embodiment thereof, it is to be clearly understood that this is done only by way of example, and not as a limitation to the scope of the invention, as set forth in the objects thereof, and in the appended claims.

We claim:

1. An improved pump housing of the so-called vortex-flow type, having an impeller with vanes, an axial inlet, a tangential-to-radial outlet, and upper and lower housing portions, wherein the improvement comprises:

said lower housing portion is essentially of circular design; and said upper housing portion has a volute conformation, with a continuously increasing radius in the direction of said outlet.

2. An improved pump housing, according to claim 1, wherein:

said lower housing portion has a given diameter; and said upper housing portion has a smallest volute diameter which corresponds to said given diameter.

3. A housing for a vortex-flow type pump, comprising:

an upper housing portion; and a lower housing portion; wherein said upper housing portion comprises means for rotatably receiving an impeller therewithin;

said lower housing portion has a circular configuration; and said upper housing portion has a volute conformation.

4. A housing, according to claim 3, wherein:

said upper and lower housing portions cooperatively form a housing outlet.

5. A housing, according to claim 3, further including:

means defining an inlet formed in said lower housing portion.

6. A housing, according to claim 3, wherein:

said upper housing portion has a continuously increasing radius.

7. A housing, according to claim 3, wherein:

said upper housing portion has a continuously increasing axial extension.

8. A housing, according to claim 3, wherein:

said lower housing portion has a continuously decreasing axial extension.

9. A housing, according to claim 3, wherein:

said upper housing portion has a continuously increasing radius, and a continuously increasing axial extension.

10. A housing, according to claim 9, wherein:

said lower housing portion has a constant radius, and a continuously decreasing axial extension which corresponds to said continuously increasing axial extension of said upper housing portion.

* * * * *